US005320593A

United States Patent [19]

Heatwole

[11] Patent Number: 5,320,593

[45] Date of Patent: Jun. 14, 1994

[54] EXERCISING AND/OR AMUSEMENT DEVICE

[76] Inventor: Richard L. Heatwole, 1285 Grange Hall Rd., Corydon, Ind. 47112

[21] Appl. No.: 81,457

[22] Filed: Jun. 22, 1993

[51] Int. Cl.[5] ..... A63B 23/04

[52] U.S. Cl. ..... 482/146; 482/75

[58] Field of Search ..... 482/146, 70, 79, 80, 482/147, 148, 51, 75

[56] References Cited

U.S. PATENT DOCUMENTS

| | | | |
|---|---|---|---|
| D. 193,010 | 6/1962 | Krauss | D34/5 |
| D. 261,909 | 11/1981 | Heatwole | D21/66 |
| D. 281,343 | 11/1985 | Krive | D21/192 |
| 478,166 | 7/1892 | Madsen . | |
| 1,509,793 | 9/1924 | Thompson . | |
| 1,671,096 | 5/1928 | Anderson . | |
| 1,861,661 | 7/1929 | Huerlin . | |
| 1,911,390 | 5/1933 | Pullman . | |
| 2,206,902 | 7/1940 | Kost | 128/25 |
| 2,714,007 | 7/1955 | Jordan | 272/57 |
| 3,207,510 | 9/1965 | Gibson | 272/57 |
| 3,416,792 | 12/1968 | Morgan et al. | 272/60 |
| 3,511,500 | 5/1970 | Dunn | 272/79 |
| 3,531,110 | 9/1970 | Marchu | 272/57 |
| 3,582,066 | 6/1971 | Keryluk | 272/57 |
| 3,612,519 | 10/1971 | Larson | 272/57 A |
| 3,638,940 | 2/1972 | Mehaulic | 272/83 R |
| 3,785,642 | 1/1974 | Sterlicchi | 272/70 |
| 3,854,717 | 12/1974 | Judkins et al. | 482/146 |
| 3,929,329 | 12/1975 | Rivera | 272/57 D |
| 3,984,100 | 10/1976 | Firster | 272/96 |
| 4,101,136 | 7/1978 | Corll | 272/97 |
| 4,111,416 | 9/1978 | Jinotti | 272/96 |
| 4,186,920 | 2/1980 | Fiore et al. | 272/96 |
| 4,199,137 | 4/1980 | Giguere | 272/96 |
| 4,200,282 | 4/1980 | Agyagos | 272/146 |
| 4,279,415 | 7/1981 | Katz | 272/70 |
| 4,285,516 | 8/1981 | Heatwole | 482/146 |
| 4,376,532 | 3/1983 | Hunstad | 272/97 |
| 4,530,498 | 7/1985 | Heatwole | 482/146 |
| 4,530,498 | 7/1985 | Heatwole | 272/146 |
| 4,603,851 | 8/1986 | Russell | 272/96 |
| 4,613,130 | 9/1986 | Watson | 272/135 |
| 4,629,181 | 12/1986 | Krive | 272/97 |
| 4,635,932 | 1/1987 | Dewees | 482/146 |
| 4,669,722 | 6/1987 | Rangaswamy | 272/96 |
| 4,700,947 | 10/1987 | Heatwole | 482/146 |
| 4,700,947 | 10/1987 | Heatwole | 272/146 |
| 4,705,028 | 11/1987 | Melby | 128/25 B |
| 4,739,986 | 4/1988 | Kucharik et al. | 482/146 |
| 4,817,950 | 4/1989 | Goo | 482/146 |
| 4,900,012 | 2/1990 | Fu | 272/65 |
| 4,966,364 | 10/1990 | Eggenberger | 272/111 |
| 5,035,421 | 7/1991 | Scheller | 272/96 |
| 5,062,629 | 11/1991 | Vaughan | 272/97 |
| 5,176,598 | 1/1993 | Gardner | 482/79 |

FOREIGN PATENT DOCUMENTS

| | | |
|---|---|---|
| 1372342 | 10/1974 | United Kingdom . |
| 2084029 | 9/1981 | United Kingdom . |

*Primary Examiner*—Stephen R. Crow

*Attorney, Agent, or Firm*—Seidel, Gonda, Lavorgna & Monaco

[57] ABSTRACT

An exercising and/or amusement device for receiving a person's feet and engaging a ground surface has a first and second platform spaced apart from each other. Each platform has an upper surface being adapted to receive one of the person's feet. A ground engaging element is associated with each of the platforms and has a dome-shaped bottom surface wherein the outer edge selectively engages the ground surface. A pivotable connector connects the platform and the associated ground engaging element and consists of a curved surface on the platform spaced from the upper surface. The element has a complimentary curved surface spaced from the bottom surface. The curved surfaces on the platform and ground engaging element slideably engage each other. The curved surface of the platform has a slot with its major axis extending along a longitudinal axis defined by an imaginery line between the platforms. A bolt extends from the curved surface of the ground engaging element and through the slot in the curved surface of the platform for limiting relative movement between the curved surfaces. A compression spring carried by the platform and encircling the bolt urges the curved surface of the ground engaging element into engagement with the curved surface of the platform and urges the ground engaging element towards a centering position relative to the platform.

20 Claims, 3 Drawing Sheets

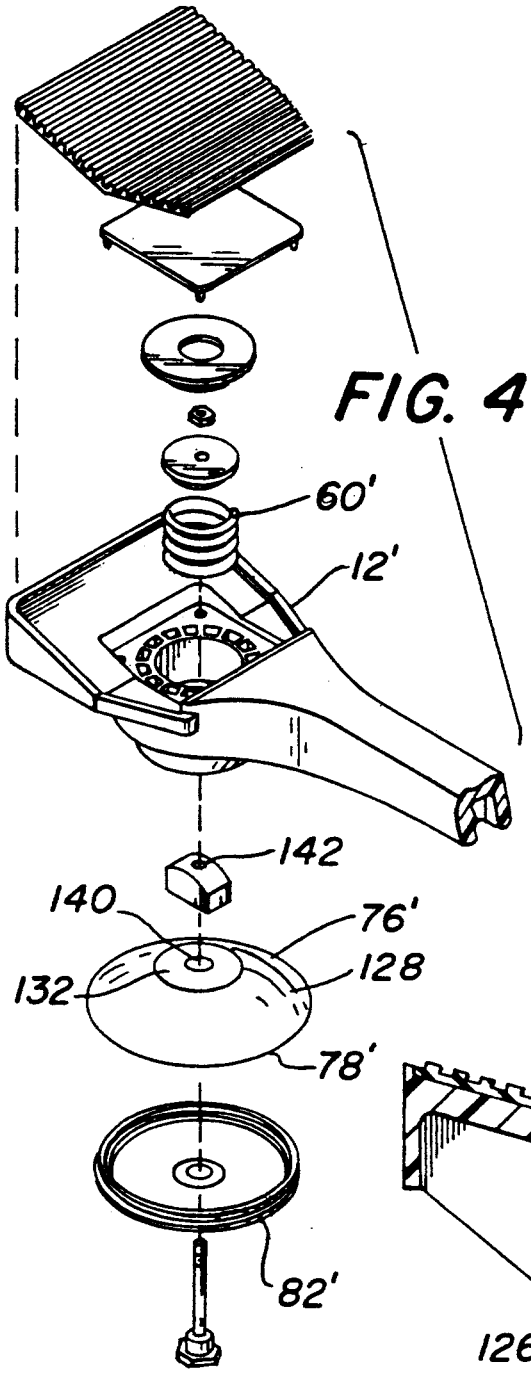
FIG. 4
FIG. 6
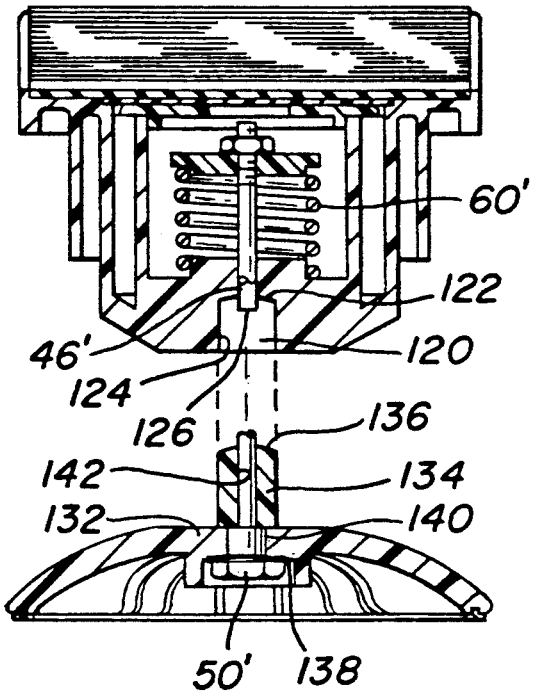
FIG. 5
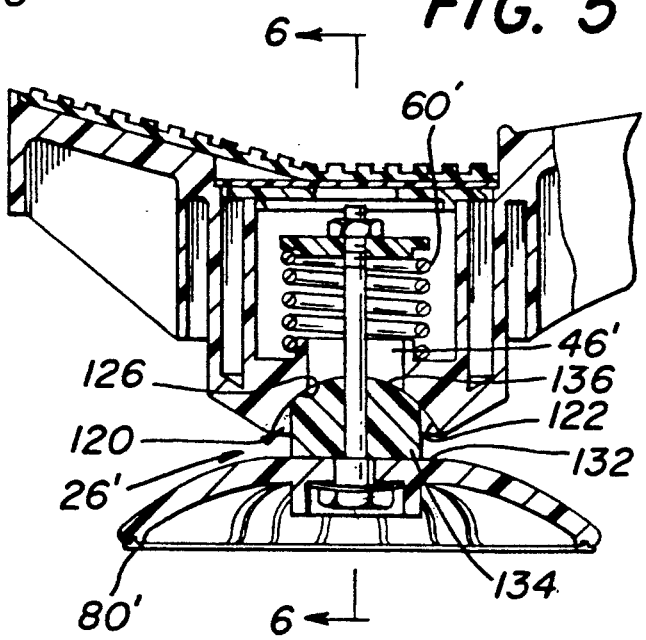

EXERCISING AND/OR AMUSEMENT DEVICE

FIELD OF THE INVENTION

This invention relates to an exerciser or a walking toy and more particularly to an exercise device having a ground engaging element with a dome-shaped bottom surface for engaging the ground surface and a curved surface engaging a complementary curved surface of a platform and a compression spring and bolt for retaining the curved surface of the ground engaging element in engagement with the platform and centering the engaging element relative to the platform.

BACKGROUND OF THE INVENTION

The present invention is directed to improvements over my earlier U.S. Pat. Nos. 4,285,516, 4,530,498, and 4,700,947 entitled "AMUSEMENT AND/OR EXERCISING DEVICE." The present invention improves the devices disclosed in the earlier patents in a number of areas including ease of manufacturing, providing for ease of learning to use the device, etc.

SUMMARY OF THE INVENTION

The present invention is directed to an exercising and/or amusement device for receiving a person's feet and engaging a ground surface and having a first and second platform spaced from each other. Each platform has an upper surface being adapted to receive one of the person's feet. A ground engaging element is associated with each of the platforms and has a dome shaped bottom surface wherein the outer edge selectively engages the ground surface. A pivotable connector connects the platform and the associated ground engaging element and consists of a curved surface on the platform spaced from the upper surface. The element has a complimentary curved surface spaced from the bottom surface. The curved surfaces on the platform and the ground engaging element slideably engage each other. The curved surface of the platform has a slot with its major axis extending along a longitudinal axis defined by an imaginary line between the platforms. A bolt extends from the curved surface of the ground engaging element and through the slot in the curved surface of the platform for limiting relative movement between the curved surfaces. A compression spring carried by the platform and encircling the bolt urges the curved surface of the ground engaging element into engagement with the curved surface of the platform and urges the ground engaging element towards a center position relative to the platform.

One object, feature and advantage resides in the provision of a compression spring carried by the platform for urging the curved surface of the ground engaging element into engagement with the curved surface of the platform and for biasing the ground engaging element towards a center position relative to the platform.

Another object, feature and advantage resides in the provision of a dome-shaped bottom surface wherein the outer edge engages the ground surface allowing for a more secure engagement particularly if the ground surface is not flat or contains small objects such as pebbles, gravel, and the like.

Further objects, features and advantages of the present invention will become more apparent to those skilled in the art as the nature of the invention is better understood from the accompanying drawings and detailed description.

DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 4 is an exploded view of an alternative embodiment;

FIG. 5 is a sectional view similar to FIG. 2 of the alternative embodiment; and

FIG. 6 is a sectional view taken along the line 6—6 in FIG. 5 with the ground engaging element and a portion of the carriage bolt exploded downward.

DESCRIPTION OF THE INVENTION

Figure 1:
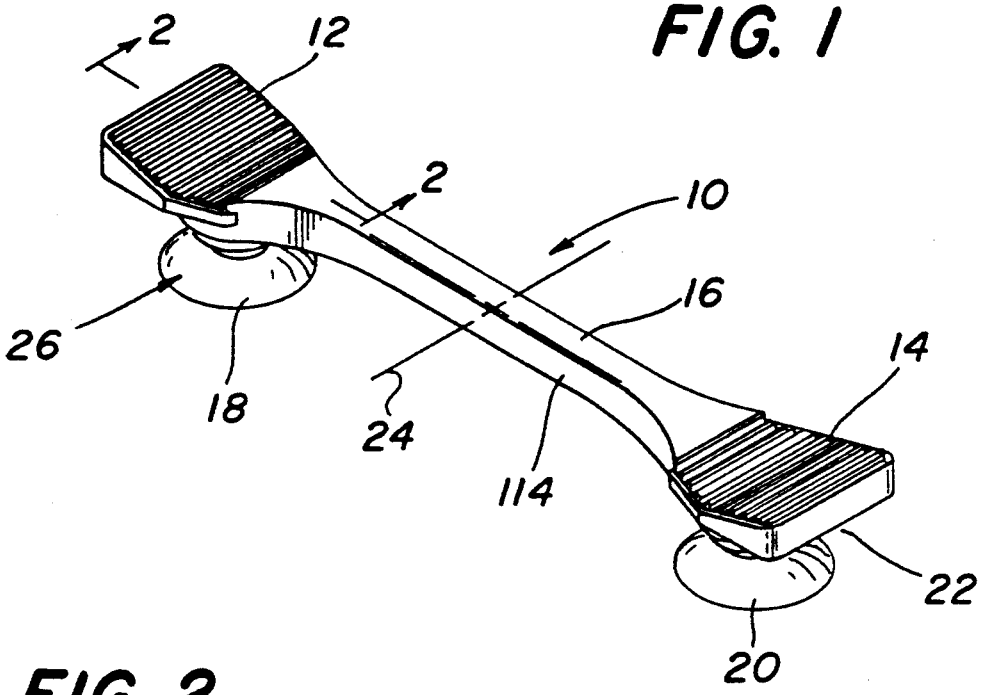
FIG. 1 is a perspective view of the device of the present invention.

Referring to the drawings in detail, wherein like numerals indicate like elements and where primes (') indicate counterparts of such like elements, there is illustrated a device in accordance with the present invention designated generally as 10.

Referring to FIG. 1, the device 10 includes a pair of platforms designated 12 and 14 to receive a person's feet. The platforms 12 and 14 are rigidly connected together by way of a cross member 16. The platforms 12 and 14 and the cross member 16 are preferably formed integral in one piece.

Each platform 12 and 14 has an associated ground engaging element 18 and 20 respectively for engaging the ground surface. The ground engaging elements 18 and 20 are connected to the platforms 12 and 14 by a pivotal connection means that allows arcuate motion of the element relative to the respective platform along the longitudinal direction (the longitudinal direction is defined by an axis 22 extending along an imaginary line through both platforms 12 and 14), while limiting relative motion in the transverse direction (the transverse direction is defined by an axis 24 that extends through the cross member 16 and is perpendicular to the longitudinal axis 22).

The connection means between the elements and the platforms are identical. Hence, only the platform 12, the element 18 and the connection means 26 between element 18 and the associated platform 12 will be described in reference to FIGS. 2 and 3.

Figure 2:
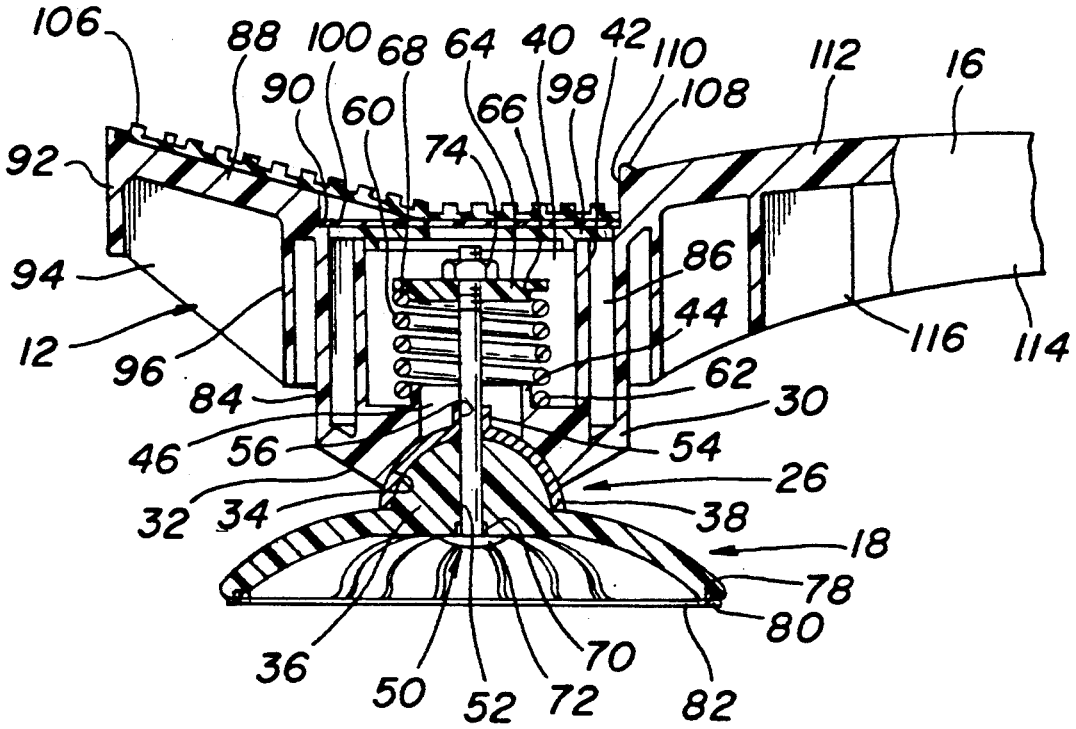
FIG. 2 is a sectional view taken along the line 2—2 in FIG. 1.

Referring to FIG. 2, the platform 12 has a cylindrical portion 30 with a frusto-conical tapered bottom 32 having a partial spherical concave surface 34 portion of the connection means 26. In addition, referring to FIG. 3, the ground engaging element 18 has a hemispherical convex surface 36 covered by a hemispherical convex shell 38 of high wear resistance material such as DELRIN® which is received in the partial spherical concave surface 34.

Located above the partial spherical concave surface 34 of the platform 12 within the cylindrical portion 30 is a bore 40 defined by a cylindrical inner wall 42. An annular boss 44 projects upward from the bottom of the bore 40. An elongated slot 46 extends upward from the apex of the partial spherical concave surface 34 through the annular boss 44 located at the bottom of the bore 40. The major axis of the elongated slot 46 runs in the longitudinal direction, towards and away from the cross member 16 and the other platform 14.

A carriage bolt 50 extends through a hole 52 in the element 18 and a collar 54 defining a hole 56 in the convex shell 38. The bolt 50 extends through the elongated slot 46 into the bore 40 with the collar 54 engaging the side walls of the slot 46. The collar 54 both reduces the stress concentration on the shell 38 and is a bearing surface between the bolt 50 and the walls of the slots 46.

A helical compression spring 60 is received by the bore 40 and is concentric with the bolt 50. A lower edge 62 of the helical compression spring 60 encircles the annular boss 44 directly above the partial spherical concave surface 34. A washer 64 is received by the bolt 50 and has a circumferential recess or shoulder 66 which receives an upper edge 68 of the compression spring 60 to position the compression spring 60 relative to the bolt 50. A fastener 74 received by the bolt 50 retains the washer 64 to the upper edge 68 of the spring 60 compressing the spring 60.

The compression spring 60 maintains the convex shell 38 in engagement with the concave surface 34 of the platform 12 by pulling the bolt 50 upward. In addition, the compression spring 60 biases the ground engaging element 18 to a center position, where the bolt 50 is located in the center of the slot 46. The carriage bolt has a square shoulder 70 in proximity to a head 72 which is received by a similarly shaped opening in the ground engaging element 18 so that the bolt 50 does not rotate relative to the element 18.

Referring to FIG. 2, the ground engaging element 18 has a ribbed dome-shaped foot portion 76 which is shaped such that only an outer edge 78 of the bottom surface engages the ground surface. The edge 78 has a circumferential groove 80 for receiving a friction ring 82.

The inner wall 42 of the platform 12, which defines the bore 40, is surrounded by an outer wall 84 of the cylindrical portion 30 spaced from the inner wall 42 by ribs 86. The cylindrical portion 30 is connected to a top wall 88. A square opening, a shoulder, 90 in the top wall 88 grants access to the bore 40 which receives the compression spring 60, the washer 64 and the fastener 74. The top of the inner wall 42 is located slightly below the shoulder 90.

Figure 3:
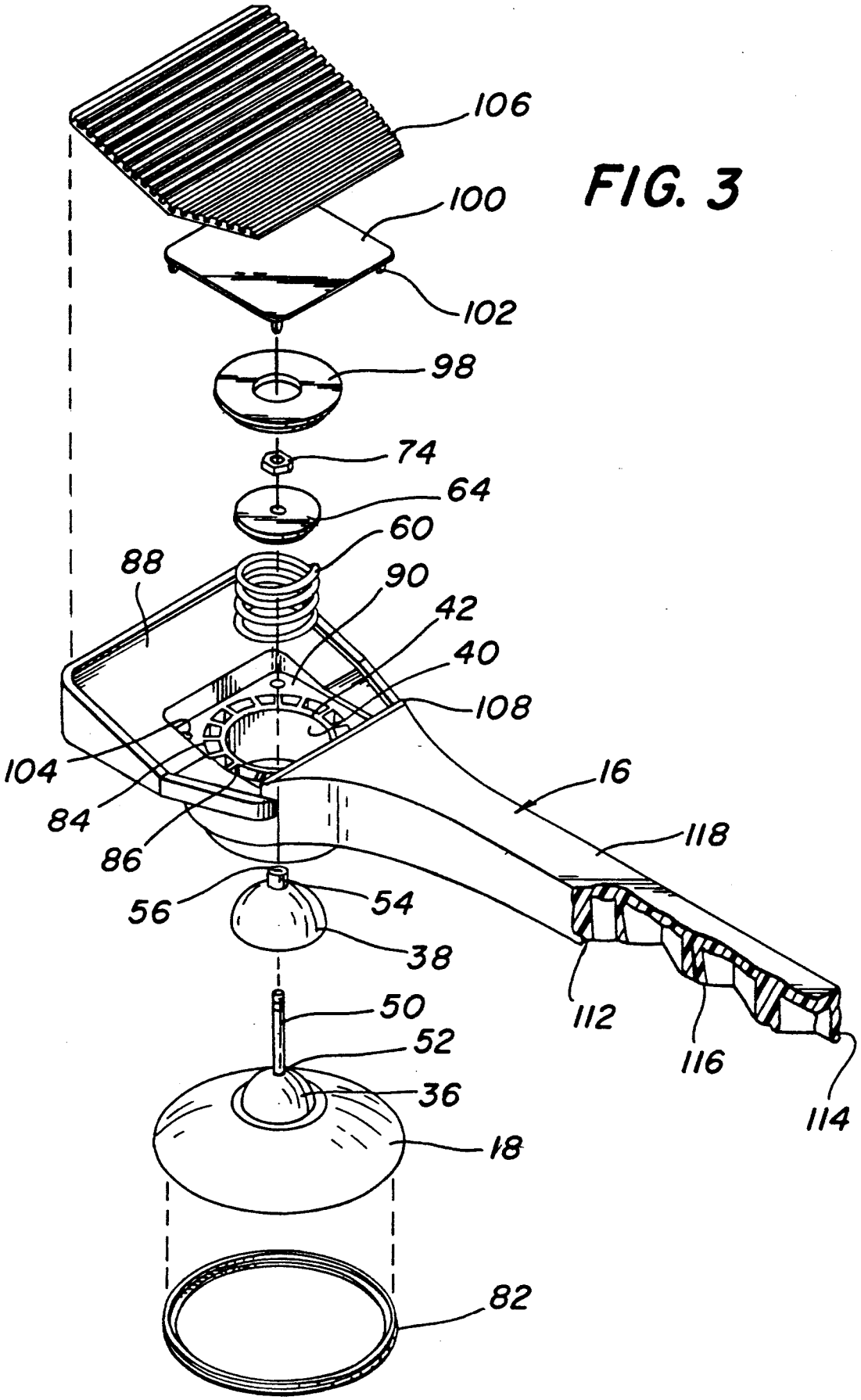
FIG. 3 is an exploded view of a portion of the exercise device.

An annular cap 98 with an access hole is adhesively mounted on top of the inner wall 42 upon assembly. Referring to FIG. 3, a square cover 100 is received by the square shoulder 90 and has four split tabs 102 received by holes 104 in the inner core 30. An anti-slip cover 106 overlies the cover 100 and the top wall 88 defining an upper surface to receive the person's foot. A ridge 108 more clearly defines a shoulder 110 at the cross member 16 platform 12 interface and helps locate the person's foot as described below.

The top wall 88 arches upward at its outer periphery and connects to a depending peripheral side wall 92. The side wall 92 is connected to the cylindrical portion 30 by way of a plurality of radial ribs 94 with an intervening generally circular perpendicular rib 96.

The cross member 16 includes a top wall 112 and side walls 114. Crisscross ribbing 116 in the cross member 16 provides substantial stability and resistance to twisting.

The device 10 is preferably molded from an A.B.S. plastic such as the material sold under the tradename CYCOLAC TM. The shell 38 is made from polymeric plastic material such as DELRIN ® to create a bearing surface between the concave surface 34 of the platform 12 and the hemispherical convex surface 36 of the ground engaging element 53, which are like materials. The antislip cover 106 and the friction ring 82 are preferably made from neoprene rubber having a durometer of 80 to 90. Other equivalent polymeric plastics may be used.

In Operation

A person wishing to use the device mounts the device 10, with their feet located on the anti-slip cover 106 directly above the compression spring 60 and washer 64. The shoulder 110 helps ensure that the feet are not located too far inward by creating a ledge to butt the foot against and ensures correct foot placement so the occupant does not have to look .down at the exercise device as she/he mounts or dismounts the device 10. The person shifts her/his feet outward to the outer periphery of the anti-slip cover 106 in proximity to the side wall 92. The person shifts her/his weight to one leg and associated platform, therein the ground engaging element associated with the opposite leg lifts to slightly elevate it off the ground surface, with the ground engaging element, associated with the weight, shifting relative to the platform. The slot 46 in the platform 12 limits the movement of the ground engaging element to motion in the longitudinal direction and thereby preventing forward and backward rocking, motion in the transverse direction, of the exercising device 10. The bolt 50 moves beyond the center and towards the other platform 14 in instances where the ground engaging element 18 is engaging an elevated surface such as a curb.

The platform is pivoted relative to the ground engaging element in contact with the ground surface to allow movement and then the return to the ground. The process is repeated with the opposite foot. At any time, the platform may be rotated 360° with respect to one of the ground engaging elements with the bolt 50 rotating relative to the platform 14.

The dome-shaped surface of the ground engaging element 18 in conjunction with the friction ring 82 allows for a more secure engagement whereby if the surface is not perfectly flat or has small objects (i.e. pebbles, gravel or dirt), the ground engaging element 18 will still be steady. When the ground engaging element 18 is raised from the ground surface, the compression spring 60 will rotate the ground engaging element 18 back to the center position.

FIGS. 4, 5 and 6 show an alternative embodiment where like numbers indicate like elements. The platform 12' is similar to the first embodiment with the exception that the connection means 26' is defined by a curved slot 120 instead of the partial spherical concave surface 34 of the first embodiment. The slot 120 has a curved upper surface 122, as best seen in FIG. 5, and two parallel side walls 124 as best seen in FIG. 6. The elongated slot 46' extends upward from the apex of the curved slot 120 through the annular boss 44' located at the bottom of the bore 40'. Because of the curved upper surface 122 of the slot 120, the edge 126 of the slot 46' is lower at the edge than at the center of the slot 46'.

A ground engaging element 128 has a dome-shaped foot portion 76' shaped such that only an outer bottom edge 78' engages the ground surface. The edge 78' has a circumferential groove 80' for receiving a friction ring 82'. The dome-shaped foot portion 76' has a flat upper surface 132 spaced from the outer bottom edge 78'. A block 134 carried on the flat upper surface 132 of the dome-shaped foot portion 76' has a complementary curved surface 136 to be received by the curved upper surface 122 of the slot 120. The carriage bolt 50' receives a washer 138 and extends through a hole 140 in the flat surface 132 of the dome-shaped foot portion 76' and a hole 142 in the block 134 whereby the bolt is capable of rotating relative to the dome-shaped foot portion 76' about the bolt 50'. While the detail of the Figures do not clearly show the space, there is a space between the bolt 50' and the block 134 to allow for the rotation. The bolt 50' extends through the slot 46' in the platform 12' and is encircled by a compression spring 60' similar to the first embodiment.

The compression spring 60' maintains the block 134 in engagement with the curved upper surface 122 of the slot 120. Both the slot 120 and the elongated slot 46' interact with the block 134 and the bolt 50', respectively, to limit the shifting to motions towards and away from the other platform.

Various modifications of the present invention can be attained. For example, the concave surface 34 and the convex surface 36 could be portions of larger diameter spheres. The elongated slot 46 could be replaced with a large opening therein allowing greater tilting of the platform 12 relative to its ground engaging element. The friction ring 82 could be eliminated and the entire dome-shaped foot portion 76 made out of a rigid high friction material. It is recognized that an anti-slip material could be molded into the platforms 12 and 14 in place of a separate anti-slip cover 106.

The present invention may be embodied in other specific forms without departing from the spirit or essential attributes thereof and, accordingly, reference should be made to the appended claims, rather than to the foregoing specification, as indicating the scope of the invention.

I claim:

1. An exercising and/or amusement device for receiving the feet of a person and engaging a ground surface, comprising:

a first and second platform spaced from each other, each platform having an upper surface being adapted to receive one of the feet of the person;

a ground engaging element associated with each platform, and having a bottom surface for selectively engaging the ground surface; and pivotable connection means connecting the platform and its associated ground engaging element comprising a curved surface on the platform spaced from the upper surface had a complimentary curved surface on the ground engaging element spaced from the bottom surface wherein the curved surfaces slideably engage each other, the curved surface of the platform having an opening, linking means extending from the curved surface of the ground engaging element and through the opening in the curved surface of the platform for controlling relative movement between the curved surfaces, and bias means for urging the curved surface of the ground engaging element into engagement with the curved surface of the platforms and for biasing the ground engaging element towards a center position relative to the platform.

2. An exercising and/or amusement device as in claim wherein the curved surface of the ground engaging element has an opening; and the linking means is a bolt extending through said opening and the opening in the curved surface of the platform and has a head located at one end and a fastening means at the other end.

3. An exercising and/or amusement device for receiving the feed of a person and engaging a ground surface, comprising:

a first and second platform spaced from each other, each platform having an upper surface being adapted to receive one of the feet of the person;

a ground engaging element associated with each platform, and having a bottom surface for selectively engaging the ground surface; and pivotable connection means connecting the platform and its associated ground engaging element comprising a curved surface on the platform spaced from the upper surface and a complimentary curved surface on the ground engaging element spaced from the bottom surface wherein the curved surfaces slidably engage each other, the curved surface of the platform having an opening, the curved surface of the ground engaging element having an opening, a bolt having a head located at one end and a fastening means at the other end, and extending through the opening in the curved surface of the ground engaging element and through the opening in the curved surface of the platform for controlling relative movement between the curved surfaces, and a compression spring carried by the platform and encircling the bolt for urging the curved surface of the ground engaging element into engagement with the curved surface of the platforms and for biasing the ground engaging element towards a center position relative to the platform.

4. An exercising and/or amusement device as in claim 3 wherein the ground engaging element has a dome-shaped bottom surface wherein the outer edge engages the ground surface.

5. An exercising and/or amusement device as in claim 3 wherein the opening in the curved surface of the platform is a slot with its major axis extending towards and away from the other platform.

6. An exercising and/or amusement device for receiving the feet of a person and engaging a ground surface, comprising:

a first and second platform rigidly spaced from each other, each platform having a pad being adapted to receive one of the feet of the person;

a ground engaging element below and associated with each platform, the ground engaging element having a bottom surface for selectively engaging the ground surface; and pivotable connection means connecting the platform and its associated element comprising a curved surface on the platform spaced from the pad and a curved surface on the ground engaging element spaced from the bottom surface, and one of the curved surfaces being a concave curved surface and the other curved surface being a complementary convex curved surface for engaging the concave surface, the curved surface of the platform having an opening and the curved surface of the ground engaging element having an opening, linking means extending from the curved surface of the ground engaging element and through the opening in the curved surface of the platform for controlling relative movement between the curved surfaces, and bias means for urging the curved surface of the ground engaging element into engagement with the curved surface of the platform and for biasing the ground engaging element towards a center position relative to the platform.

7. An exercising and/or amusement device as in claim 6 wherein the linking means is a bolt extending through the opening of the curved surface of the ground engaging element and through the opening in the platform and having a head located at one end and a fastening means at the other end; and bias means is a compression spring carried by the platform and encircling the bolt.

8. An exercising and/or amusement device as in claim 7 wherein the ground engaging element has a dome-shaped bottom surface wherein the outer edge engages the ground surface.

9. An exercising and/or amusement device as in claim 8 wherein the opening in the curved surface of the platform is a slot with its major axis extending towards and away from the other platform.

10. An exercising and/or amusement device as in claim 7 wherein the concave curved surface is on the platform and the convex curved surface is on the ground engaging element.

11. An exercising and/or amusement device as in claim 10 wherein the convex curved surface is a hemisphere and the concave curved surface is a partial hemisphere.

12. An exercising and/or amusement device as in claim 11 wherein the ground engaging element has a dome-shaped bottom surface wherein the outer edge engages the ground surface.

13. An exercising and/or amusement device as in claim 12 wherein the opening in the curved surface of the platform is a slot with its major axis extending towards and away from the other platform.

14. An exercising and/or amusement device as in claim 13 wherein the ground engaging element - bolt interface has an anti-rotation means to prohibit the rotation of the bolt relative to the ground engaging element.

15. An exercising and/or amusement device for receiving the feet of a person and engaging a ground surface, comprising:

a first and second platform rigidly spaced from each other, each platform having an upper surface being adapted to receive one of the feet of the person;

a ground engaging element associated with each of the platforms, and having a bottom surface for selectively engaging the ground surface; and pivotable connection means connecting the platform and its associated ground engaging element comprising a curved surface on the platform spaced from the upper surface, a curved surface on the ground engaging element spaced from the bottom surface and rotatable relative to the bottom surface, one of the curved surfaces being a circle segment surface and the other curved surface defined by a slot having a complimentary circle segment surface wherein the curved surfaces slideably engage each other, the curved surface of the platform having an opening, linking means extending from the curved surface of the ground engaging element and through the opening in the curved surface of the platform for controlling relative movement between the curved surfaces, and bias means for urging the curved surface of the ground engaging element into engagement with the curved surface of the platform and for biasing the ground engaging element towards a center position relative to the platform.

16. An exercising and/or amusement device as in claim 15 wherein the ground engaging element has a block having the curved surface and the block rotatable relative to the bottom surface about the link means.

17. An exercising and/or amusement device as in claim 16 wherein the curved surface of the block being a convex circle surface and the curved surface of the platform being concave circle surface.

18. An exercising and/or amusement device as in claim 17 wherein the linking means is a bolt extending through the hole of the curved surface of the ground engaging element and through the opening in the platform and having a head located at one end and a fastening means at the other end; and bias means is a compression spring carried by the platform and encircling the bolt.

19. An exercising and/or amusement device as in claim 18 wherein the ground engaging element has a dome shaped bottom surface wherein the outer edge engages the ground surface.

20. An exercising and/or amusement device as in claim 19 wherein the opening in the curved surface of the platform is a slot with its major axis extending towards and away from the other platform.

* * * * *